US009387139B2

(12) United States Patent
Chang

(10) Patent No.: US 9,387,139 B2
(45) Date of Patent: Jul. 12, 2016

(54) DUAL DRIVE WHEELCHAIR

(71) Applicant: Optimal Medical Co., LTD., Taichung (TW)
(72) Inventor: Jeng-Pang Chang, Taichung (TW)
(73) Assignee: Optimal Medical Co., LTD., Taichung (TW)

( * ) Notice: Subject to any disclaimer, the term of this patent is extended or adjusted under 35 U.S.C. 154(b) by 0 days.
(21) Appl. No.: 14/836,329
(22) Filed: Aug. 26, 2015
(65) Prior Publication Data
US 2016/0058636 A1 Mar. 3, 2016
(30) Foreign Application Priority Data
Aug. 26, 2014 (TW) ..... 103215250 U
(51) Int. Cl.
*A61G 5/02* (2006.01)
*A61G 5/10* (2006.01)
(52) U.S. Cl.
CPC ..... *A61G 5/021* (2013.01); *A61G 5/026* (2013.01); *A61G 2005/1051* (2013.01)
(58) Field of Classification Search
CPC ..... A61G 5/021; A61G 5/026; A61G 5/00; A61G 5/02; A61G 2005/51; B62M 1/24; B62M 1/28
USPC ..... 280/230
See application file for complete search history.

(56) References Cited

U.S. PATENT DOCUMENTS 3,485,510 A * 12/1969 Merlan ..... A61G 5/023 280/250
4,483,548 A * 11/1984 Zirrilo ..... A61G 5/023 280/304.1
4,824,132 A * 4/1989 Moore ..... A61G 5/023 280/250.1
5,242,179 A * 9/1993 Beddome ..... A61G 5/025 280/233
5,280,937 A * 1/1994 Needham ..... A61G 5/023 280/259
5,482,125 A * 1/1996 Pagett ..... A61G 5/042 180/6.32
6,092,822 A * 7/2000 Salmon ..... A61G 5/023 280/250.1
7,398,842 B2 * 7/2008 Fontecchio ..... B62D 11/003 180/242
7,922,184 B2 * 4/2011 Porcheron ..... A61G 5/046 180/6.28
8,651,507 B2 * 2/2014 Kylstra ..... A61G 5/10 280/250.1
2007/0114750 A1 * 5/2007 Dix ..... A61G 5/026 280/250.1
2008/0246246 A1 * 10/2008 Dix ..... A61G 5/023 280/233

* cited by examiner

*Primary Examiner* — Anne Marie Boehler
*Assistant Examiner* — Michael Stabley
(74) *Attorney, Agent, or Firm* — Tracy M. Heims; Apex Juris, pllc.

(57) ABSTRACT

A dual drive wheelchair comprising a frame with a seat, a rear driving wheel set including a cross axle and a vertical rod, wherein the cross axle connects two rear wheels, a supporting structure including a support and an axial tube, wherein the support is connected to the frame and a front driving wheel set; and the axial tube fits around the vertical rod, and further comprising a first steering member of the first turning structure connected to the support and a second steering member of the first turning structure; wherein the second steering member is fixed to the vertical rod and a control structure including a pair of backrest canes fixed to the first steering member enabling a user or a caregiver to operate the control structure of the dual drive wheelchair.

10 Claims, 10 Drawing Sheets

DUAL DRIVE WHEELCHAIR

BACKGROUND OF THE INVENTION

1. Technical Field

The present invention relates generally to a wheelchair, and more particularly to a dual drive wheelchair.

2. Description of Related Art

A conventional rehabilitation wheelchair includes not only a push handle allowing a caregiver to hold for pushing the wheelchair, but also a pedal structure for disabled users who still have partial leg functions to pedal forth, by which to maintain a lightweight exercise to prevent degeneration. However, the pedal structure revolves along with the movement of the wheelchair, and therefore is unsuitable for patients suffering a leg fracture or paraplegics.

In addition, a conventional rehabilitation wheelchair may further include a steering controller on an armrest for users to operate the wheelchair, which is usually provided on the right armrest. As a result, such a steering controller is awkward and problematic for left-handed people or people having an injured right hand. Thus, the conventional rehabilitation wheelchair is inconvenient for some users, and drawbacks leaving room for improvement persist.

BRIEF SUMMARY OF THE INVENTION

In view of the above, the primary objective of the present invention is to provide a dual drive wheelchair, which allows a user to operate independently, or serves as a plain wheelchair without a pedaling function that has to be controlled by a caregiver.

The present invention provides a dual drive wheelchair which includes a frame, a front driving wheel set, a rear driving wheel set, a supporting structure, a first turning structure, and a control structure. The frame includes a seat. The front driving wheel set includes a pair of front wheels. The rear driving wheel set includes a cross axle and a vertical rod, wherein the cross axle has two ends to connect a pair of rear wheels respectively; the vertical rod is connected to the cross axle. The supporting structure is provided under the frame, and includes a support and an axial tube. The support is connected to the frame with an end, while another end of the support is connected to the front driving wheel set. The axial tube is connected to the support, and has an axle hole for the vertical rod of the rear driving wheel set to pass through. The first turning structure includes a first steering member and a second steering member, wherein the first steering member has a first end and a second end. The first end is connected to the support, and the second end is pivotally connected to an end of the second steering member; another end of the second steering member is fixed to an end of the vertical rod which is exposed out of the axial tube. The control structure includes a pair of backrest canes, wherein each of the backrest canes is fixed to the first steering member with an end thereof, while another end of each of the backrest canes forms a handle.

The dual drive wheelchair of the present invention is thereby able to be controlled by the user independently with the pedaling function for enhanced rehabilitation. In addition, the dual drive wheelchair can alternatively serve as a plain wheelchair which has to be controlled by a caregiver.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
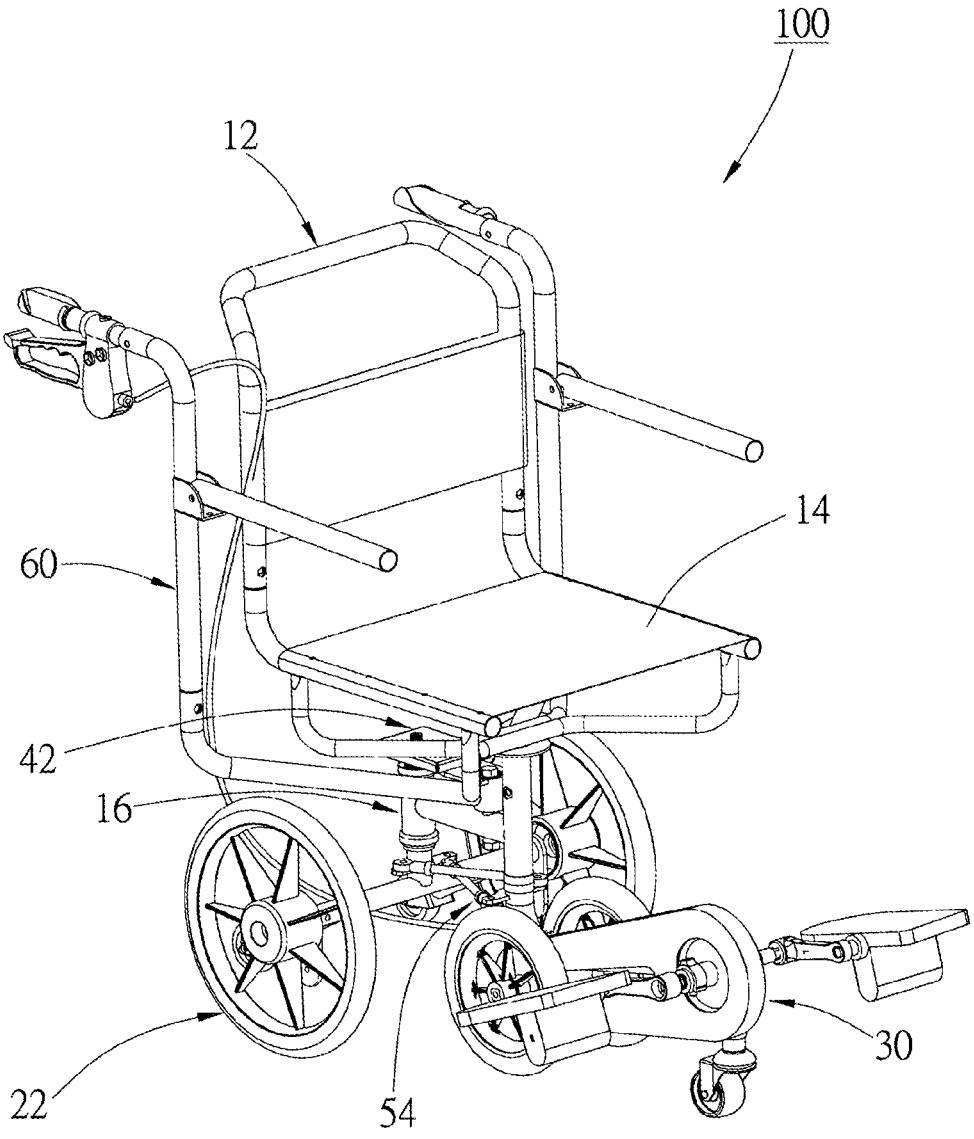
FIG. 1 is a perspective view of a preferred embodiment of the present invention.

As shown in FIG. 1, a dual drive wheelchair 100 of the preferred embodiment of the present invention includes a frame 12, a supporting structure 16, a rear driving wheel set 22, a front driving wheel set 30, a first turning structure 42, a second turning structure 54, and a control structure 60.

As shown in FIG. 1 to FIG. 4, the frame 12 includes a seat 14 for a user to sit thereon. The supporting structure 16 is connected to a bottom of the frame 12, and includes a support 18 and an axial tube 20. The support 18 consists of an extension tube 181, a connecting tube 182, a terminal tube 183, and a vertical tube 184. The extension tube 181 is L-shaped, and therefore can be divided into a horizontal section 181*a* and a vertical section 181*b*, wherein a bottom end of the vertical section 181*b* is connected to the horizontal section 181*a*. A top end of the vertical section 181*b* is connected to the frame 12. The connecting tube 182 has two ends, wherein one of the two ends is fixed to the vertical section 181*b*, while the other one is fixed to the axial tube 20. The axial tube 20 and the vertical section 181*b* of the extension tube 181 are parallel. The terminal tube 183 is fixed to a front end of the horizontal section 181*a* of the extension tube 181. The vertical tube 184 is fixed to a bottom of the terminal tube 183.

The rear driving wheel set 22 includes a vertical rod 24, a cross axle 26, and a pair of rear wheels 28. The vertical rod 24 is vertically fixed to the cross axle 26, and passes through an axle hole 201 of the axial tube 20. The cross axle 26 has two ends to connect the pair of rear wheels 28.

Figure 4:
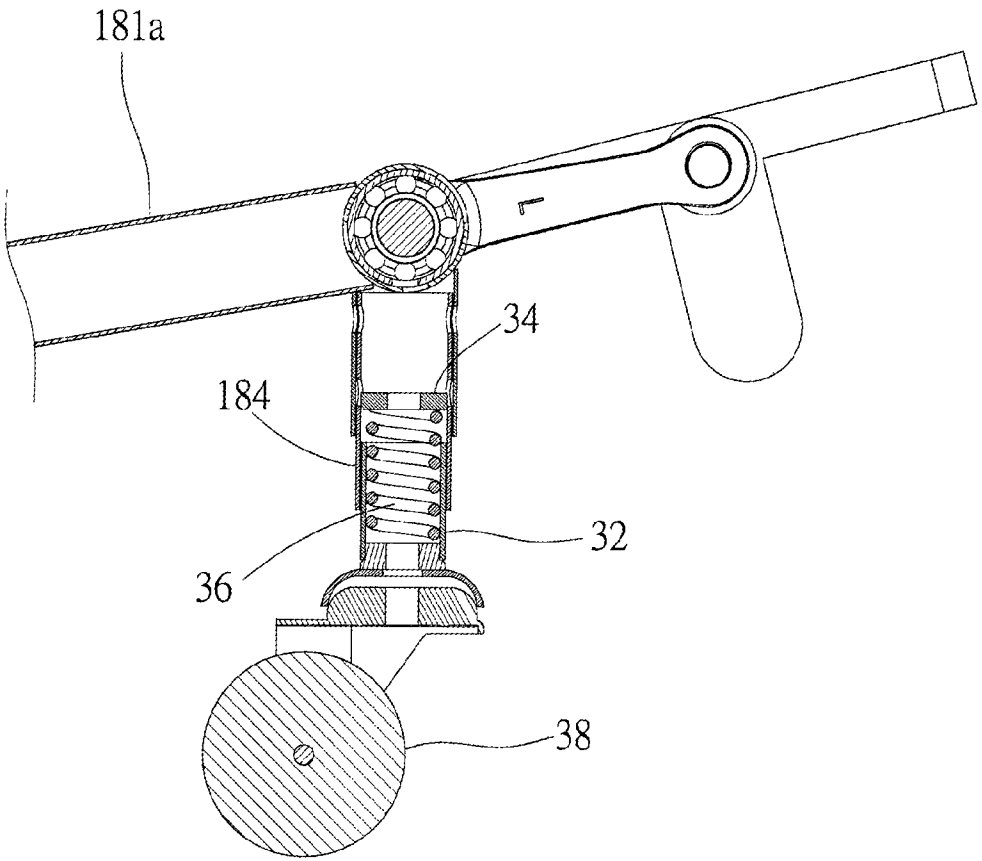
FIG. 4 is a partial sectional view of the preferred embodiment of the present invention, showing the spring abuts against the fixing ring and the adapter tube.

The front driving wheel set 30 is connected to the extension tube 181 of the supporting structure 16. More specifically, the front driving wheel set 30 includes an adapter tube 32, a fixing ring 34, a spring 36, a castor 38, and a pair of front wheels 40. The adapter tube 32 is inserted in the vertical tube 184 with an end thereof, and is connected to the castor 38 with another end thereof. The pair of front wheels 40 is indirectly connected to the terminal tube 183. The dual drive wheelchair 100 may steadily move on the ground with the support provided by the pair of the rear wheel 28, the castor 38, and the pair of front wheels 40. As shown in FIG. 4, the fixing ring 34 is received in and fixed to the vertical tube 184; the spring 36 abuts against the fixing ring 34 and the adapter tube 32 with two ends thereof respectively to absorb vibration while the dual drive wheelchair 100 is moving.

As shown in FIGS. 1, 2, 3, and 6, the first turning structure 42 includes a first steering member 44, a first shaft 48, a second steering member 50, and a second shaft 52. The first steering member 44 has a first end 441 and a second end 442, and further includes a sleeve 46. The sleeve 46 has a plurality of bearings therein (not shown), and is connected to and under the first end 441. The first shaft 48 passes through the connecting tube 182 in a radial direction of the connecting tube 182, the sleeve 46, and the first end 441 of the first steering member 44; whereby, the first steering member 44 is fixed to the extension tube 181. An end of the second steering member 50 is pivotally connected to the second end 442 of the first steering member 44 through the second shaft 52, while another end of the second steering member 50 is fixed to a top end of the vertical rod 24.

Figure 2:
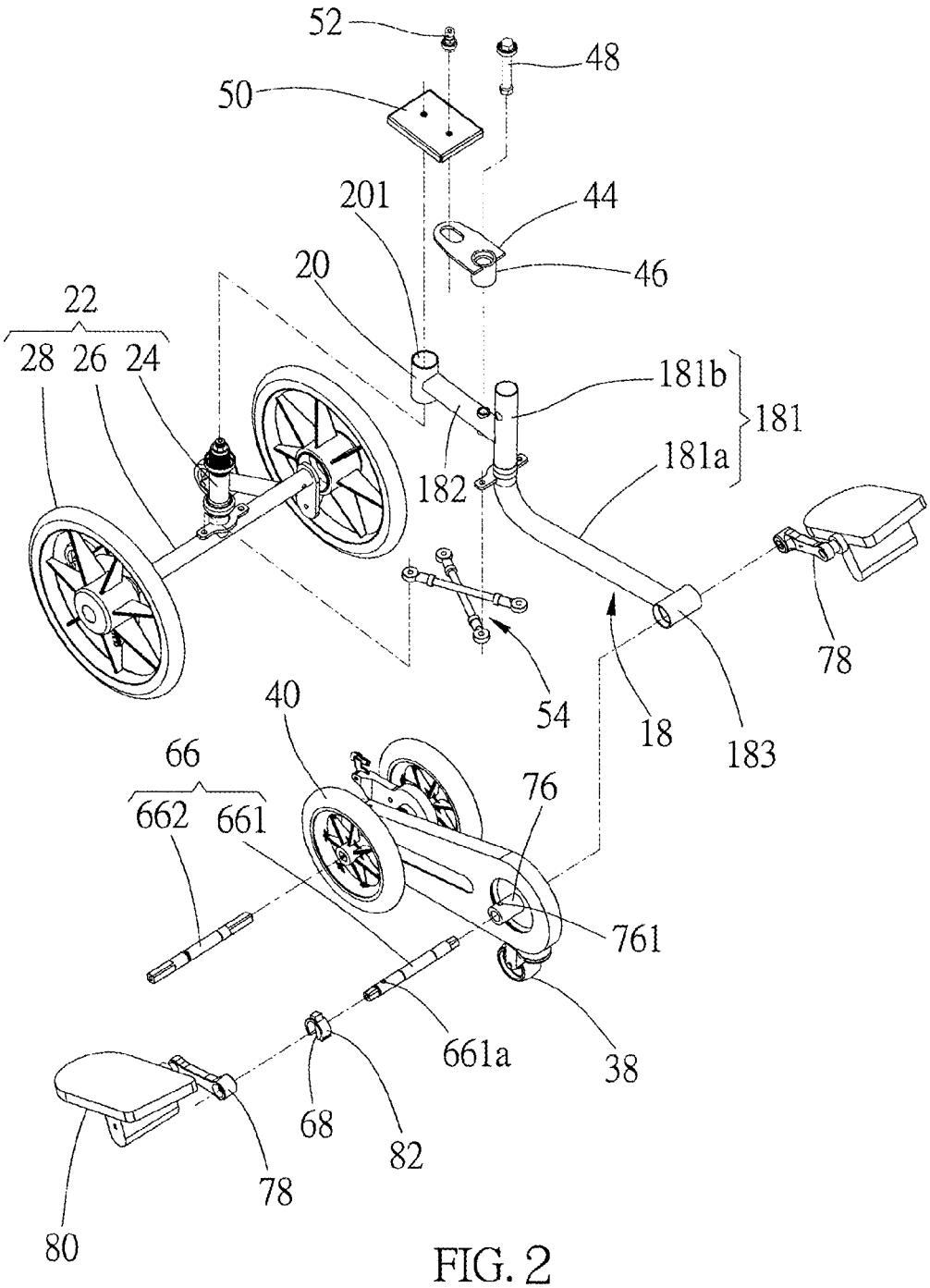
FIG. 2 is a partial exploded view of FIG. 1.
Figure 7:
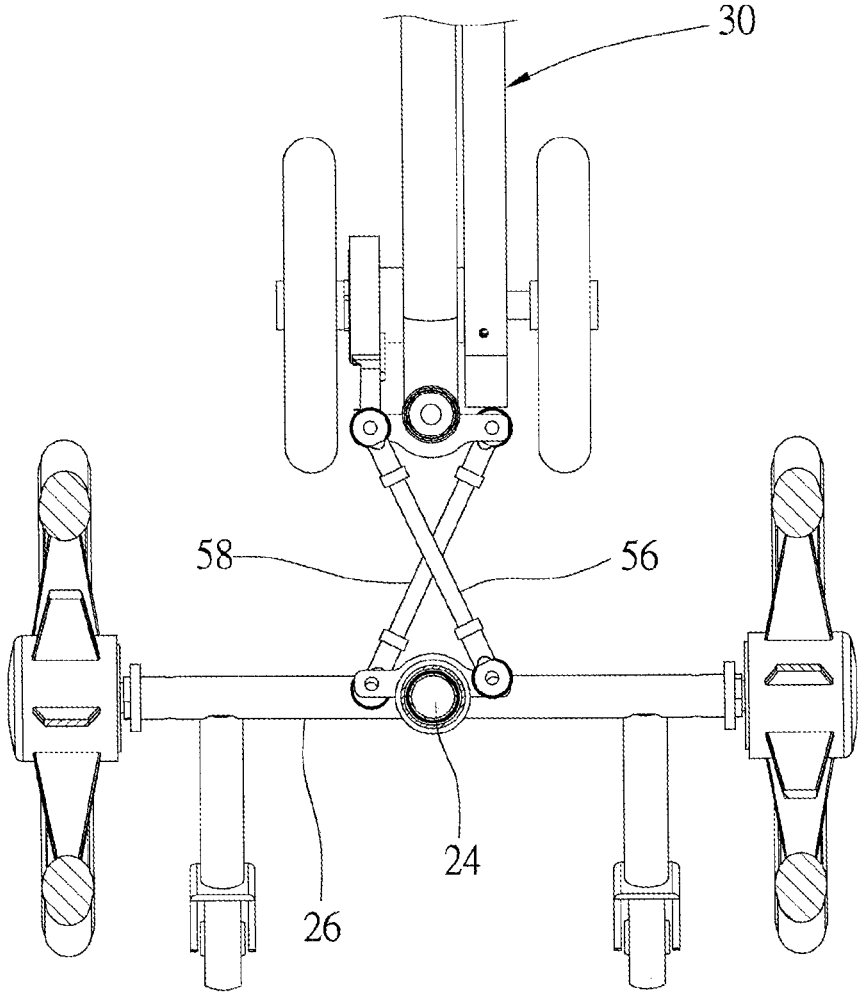
FIG. 7 is a partial sectional view, showing that the control structure, the second turning structure, and the front driving wheel set are not turned.

As shown in FIG. 2 and FIG. 7, the second turning structure 54 includes a first linkage 56 and a second linkage 58, wherein the first and the second linkages 56, 58 are intercrossed. Additionally, each of the first and the second linkages 56, 58 is connected to the extension tube 181 of the support 18 and the vertical rod 24 of the rear driving wheel set 22 with two ends respectively.

Figure 3:
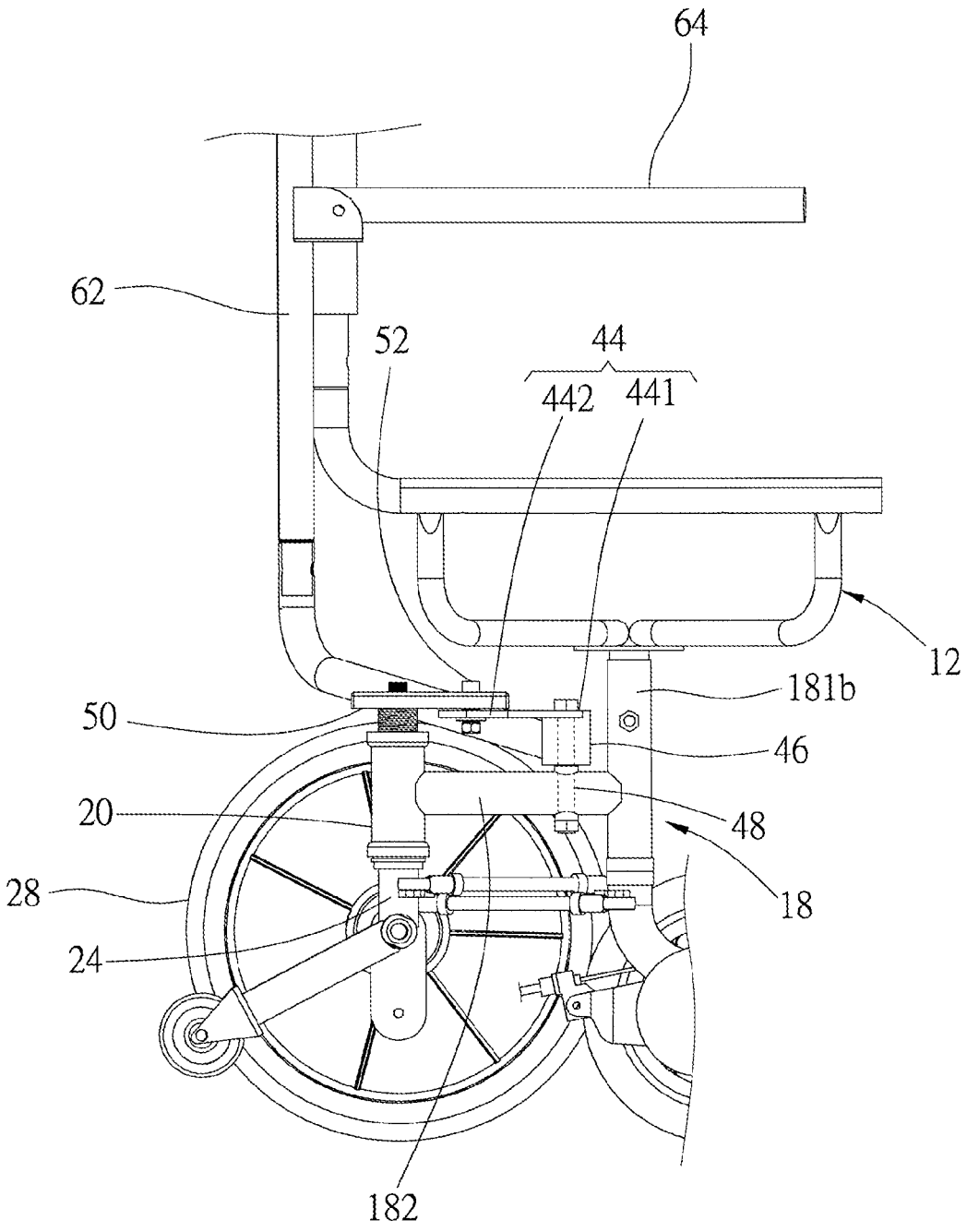
FIG. 3 is a partial lateral view of FIG. 1.

As shown in FIG. 1, FIG. 3 and FIG. 4, the control structure 60 includes a pair of backrest canes 62 and a pair of armrests 64, wherein each of the backrest canes 62 are fixed to the sleeve 46 of the first turning structure 42 with an end thereof; each of the armrests 64 is connected to one of the backrest canes 62 in a foldable way. A caregiver could hold the pair of backrest canes 62 to operate the dual drive wheelchair 100. On the other hand, the pair of armrests 64 allows the user to control the dual drive wheelchair 100 by him- or herself.

Figure 5:
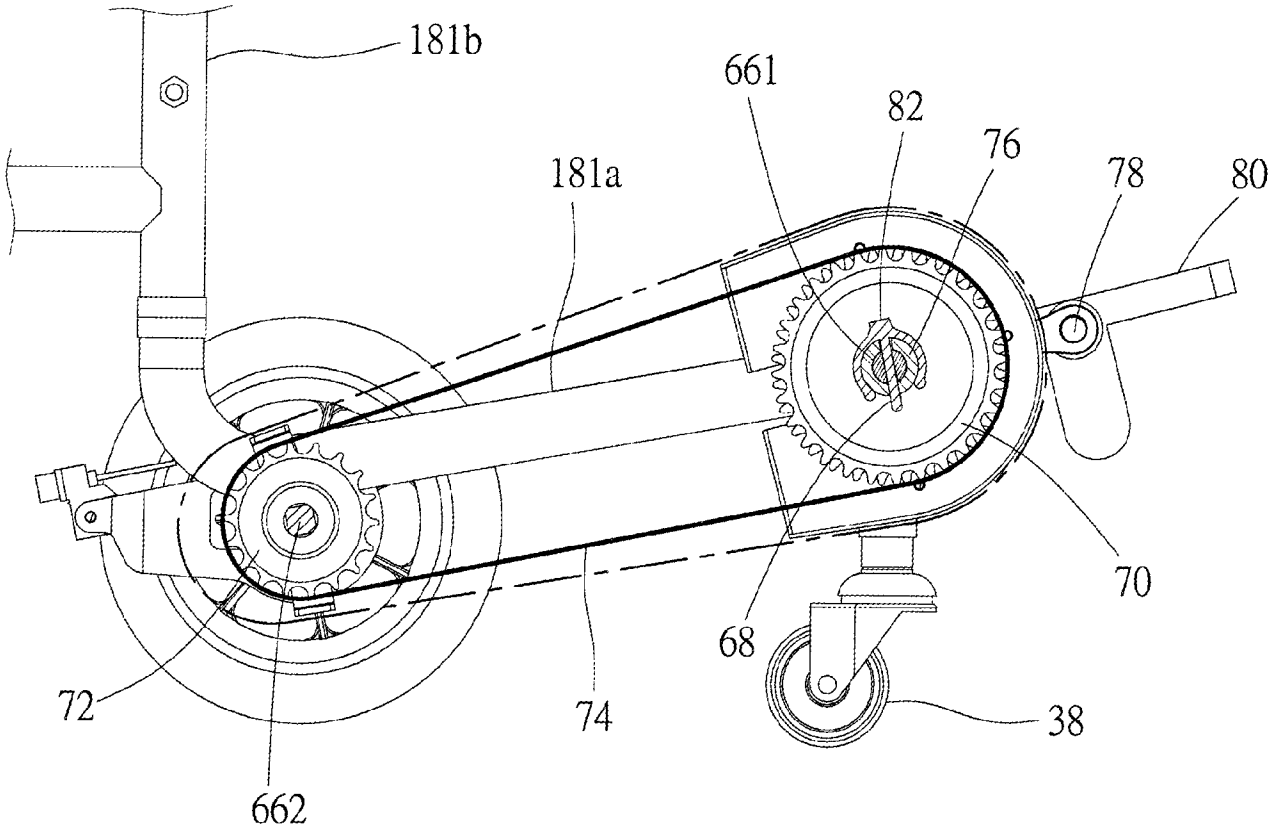
FIG. 5 is a partial sectional view, showing the front driving wheel set.
Figure 6:
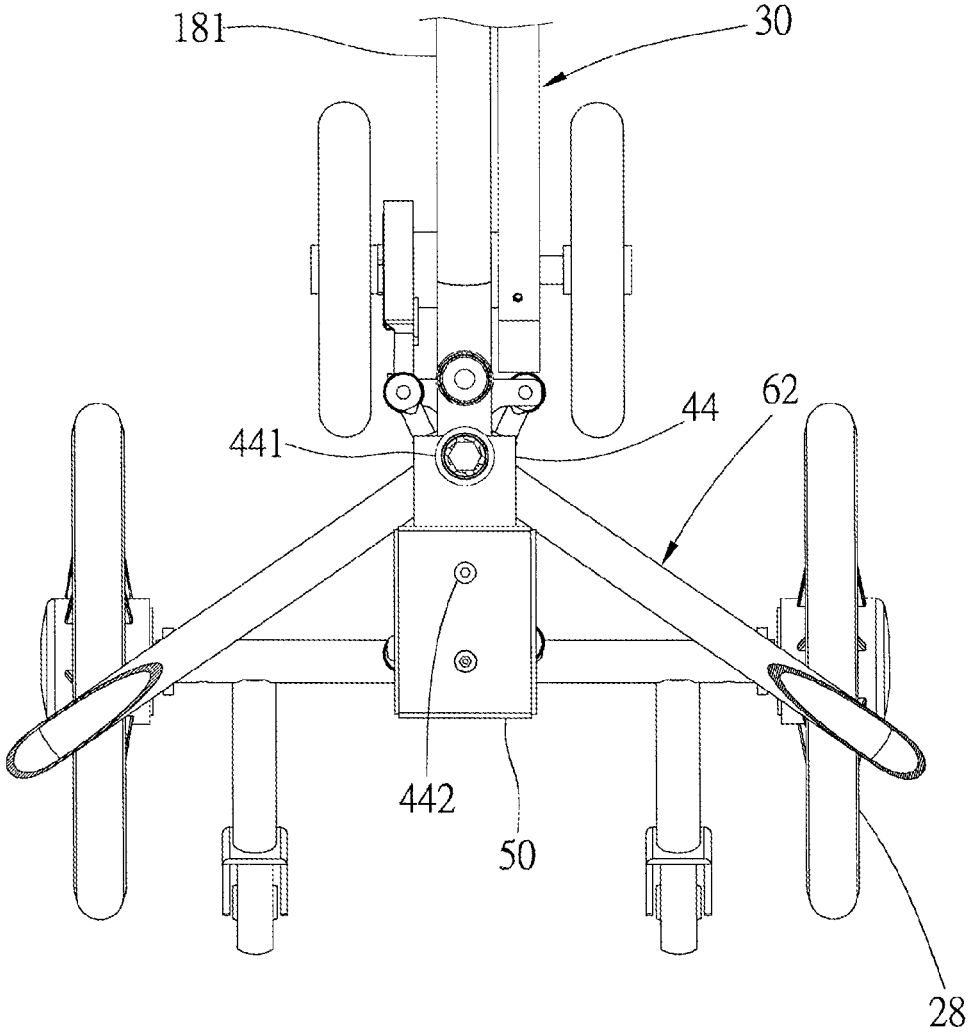
FIG. 6 is a partial sectional view, showing that the control structure, the first turning structure, and the rear driving wheel set are not turned.

Moreover, the structures of the front driving wheel set 30 are illustrated in FIG. 2 and FIG. 5, wherein the front driving wheel set 30 further includes a cover tube 76, a driving shaft set 66, a fixing bolt 68, a front gear 70, a rear gear 72, and a chain 74. The cover tube 76 is connected to the terminal tube 183. The cover tube 76 is fixed to the canter of the front gear 70, and has a first hole 761 at a top surface thereof. The driving shaft set 66 includes a front driving shaft 661 and a rear driving shaft 662, wherein the front driving shaft 661 passes through the cover tube 76 and the terminal tube 183. In addition, the front driving shaft 661 connects two cranks 78 with two ends respectively, wherein each of the two cranks 78 is connected to a pedal 80 for the user to pedal. Corresponding to the first hole 761 of the cover tube 76, the front driving shaft 661 has a second hole 661*a* at a top surface thereof. The fixing bolt 68 passes through the first hole 761 and the second hole 661*a* detachably so as to synchronize the rotation of the cover tube 76 and the front driving shaft 661. To move the fixing bolt 68 more conveniently, a clasp ring 82 is provided in the preferred embodiment, wherein the clasp ring 82 is C-shaped and flexible. The clasp ring 82 is capable of clasping the cover tube 76, and is fixed to an end of the fixing bolt 68. Whereby, the clasp ring 82 may not only avoid the fixing bolt 68 from falling off from the cover tube 76, but also allow the user to hold for pulling up the fixing bolt 68 out of the cover tube 76.

The rear driving shaft 662 is rotatably provided under the support 18, and is fixed to the center of the rear gear 72; additionally, the rear driving shaft 662 has two ends to connect the pair of front wheels 40. The chain 74 wraps around and meshes with the front gear 70 and the rear gear 72. Therefore, due to the power transmission through the chain 74, the rear driving shaft 662 may rotate along with the front driving shaft 661, which is drivable through the rotation of the pedals 80 controlled by the user. On the other hand, if the user has difficulties in pedaling, the dual drive wheelchair 100 may be served as a plain wheelchair which has no aforementioned pedal structure. In this situation, the fixing bolt 68 could be pulled out of the cover tube 76, so that the front driving shaft 661 is incapable of rotating along with the front gear 70. Therefore, the user could put his or her legs on the pedals 80 stably when the dual drive wheelchair 100 moves.

As shown in FIG. 3 and FIG. 6 to FIG. 10, rotating the pair of backrest canes 62 by the caregiver or by the user through the pair of armrest 64 could drive the rotation of the sleeve 46 and the first steering member 44, which consequently drives the rotation of the second steering member 50.

Figure 8:
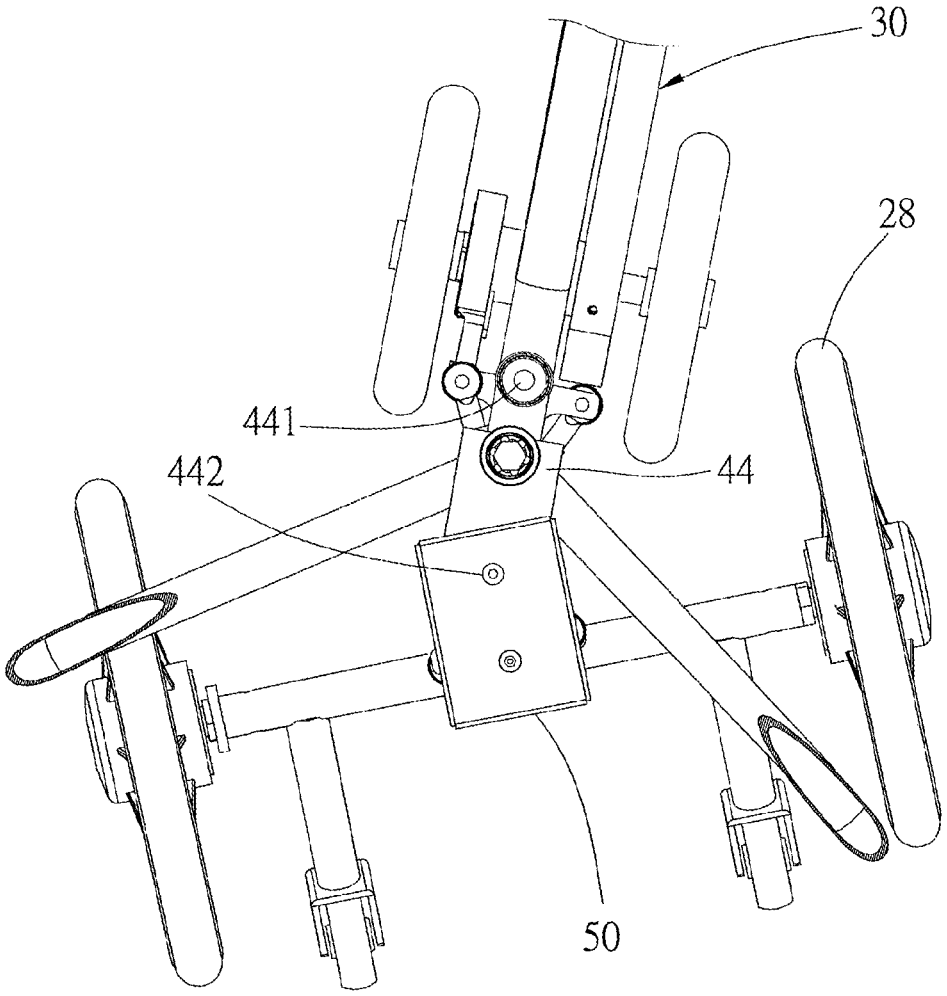
FIG. 8 is a partial sectional view, showing the condition of the first turning structure and the rear driving wheel set while the control structure is in the process of turning right.

More specifically, FIG. 8 illustrates the position of the first turning structure 42 in a process of turning the dual drive wheelchair 100 to the right. The second steering member 50 is driven to rotate by the first steering member 44. As it can be seen from the top view, the second steering member 50 pivots on the second end 442 of the first steering member 44 counterclockwise. Therefore, the moving direction of the pair of rear wheels 28 is different from that of the pair of front wheels 40 whereby the first turning structure 42 and thus the dual drive wheelchair 100 turns smoothly.

Figure 9:
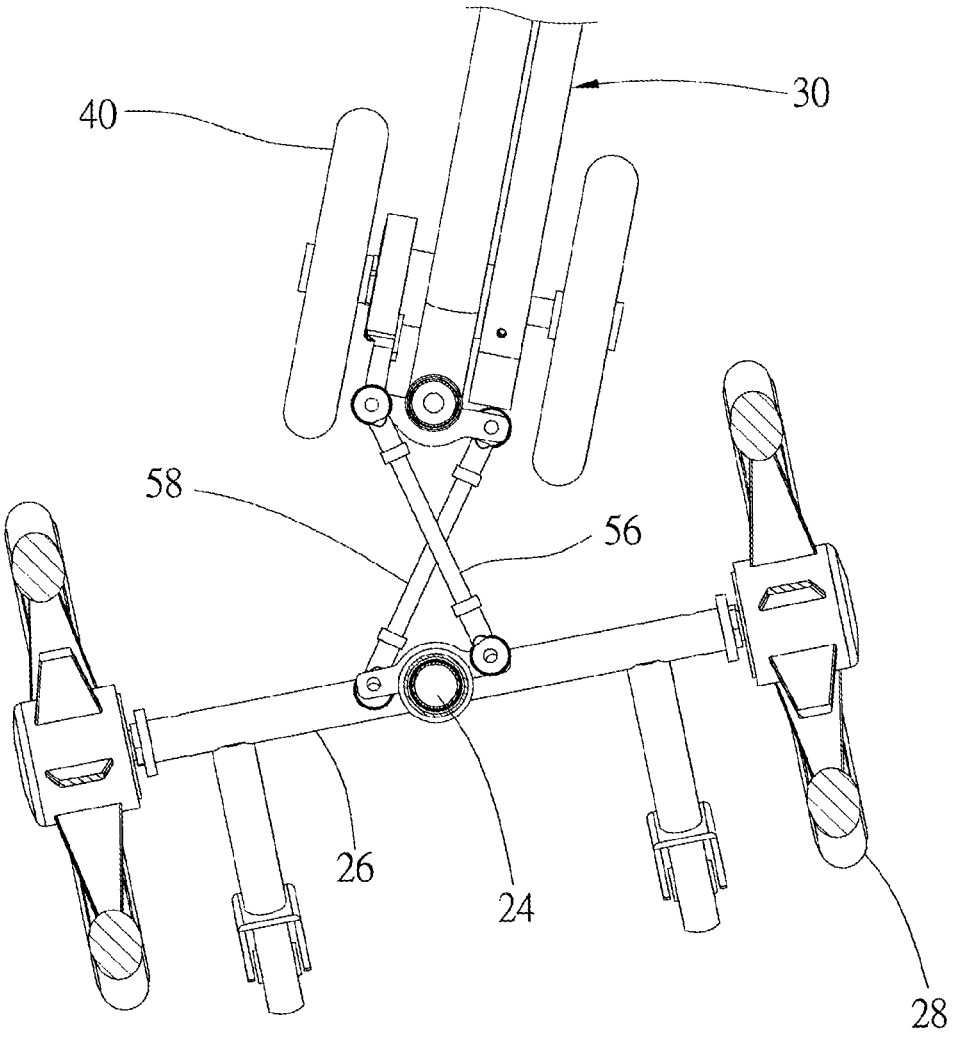
FIG. 9 is a partial sectional view, showing the condition of the second turning structure and the front driving wheel set while the control structure is in the process of turning right.

Furthermore, the position of the second turning structure 54 in a process of turning the dual drive wheelchair 100 to the right is illustrated in FIG. 9, wherein each of the first and the second linkages 56, 58 is capable of pivoting on the extension tube 181 and the vertical rod 24. When the extension tube 181 rotates along with the sleeve 46, the first and the second linkages 56, 58 respectively provide a pull force and a push force on the vertical rod 24 to change the moving direction of the pair of rear wheels 28. Whereby, the second turning structure 54 may restrict the deviation and the distance between the front wheels 40 and the rear wheels 28 to make a smooth turn.

Figure 10:
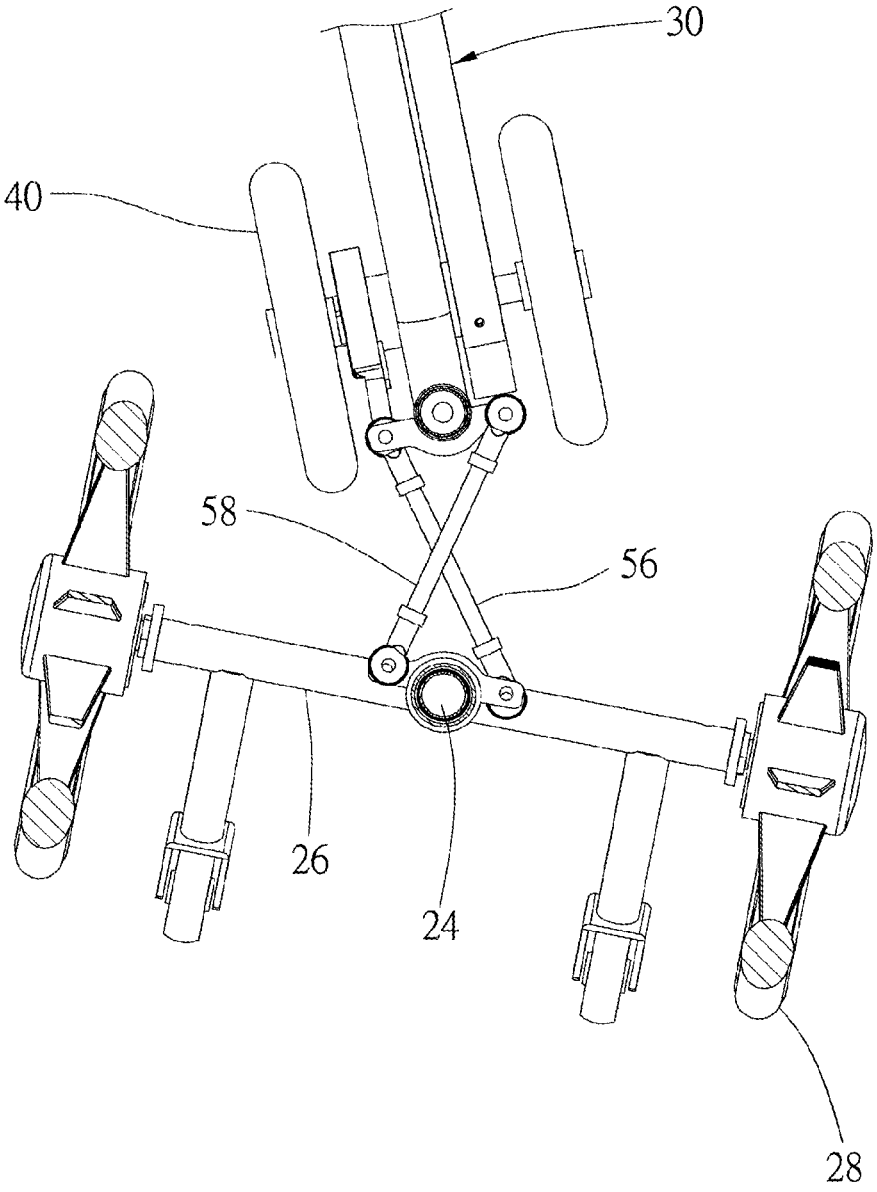
FIG. 10 is a similar to FIG. 9, showing the condition of the second turning structure and the front driving wheel set while the control structure is in the process of turning left.

On the other hand, FIG. 10 illustrates the position of the second turning structure 54 in a process of turning the dual drive wheelchair 100 to the left. In this case, the front wheels 40 move toward the left, while the rear wheels 28 move toward the right, which makes the dual drive wheelchair 100 turn smoothly.

In conclusion, distinct features of dual drive wheelchair 100 provide advantages over any known rehabilitation wheelchair. The dual drive wheelchair 100 is not only helpful for users to exercise leg muscles through pedaling, but may also be controlled by a caregiver. Accordingly, the dual drive wheelchair 100 provides enhanced efficacy and convenience as compared to existing wheelchairs. Moreover, an additional advantage of the limited deviation between the front wheels 40 and the rear wheels 28 provide smooth rolling and turning by the dual drive wheelchair 100.

It must be pointed out that the embodiments described above are only some preferred embodiments of the present invention. All equivalent structures which employ the concepts disclosed in this specification and the appended claims should fall within the scope of the present invention.

What is claimed is:

1. A dual drive wheelchair, comprising:

a frame having a seat;

a front driving wheel set including a pair of front wheels;

a rear driving wheel set including a cross axle and a vertical rod, wherein the cross axle has two ends to connect a pair of rear wheels respectively; the vertical rod is connected to the cross axle;

a supporting structure provided under the frame, including a support and an axial tube, wherein the support is connected to the frame with an end, while another end of the support is connected to the front driving wheel set; the axial tube is connected to the support, and has an axle hole for the vertical rod of the rear driving wheel set to pass through;

a first turning structure including a first steering member and a second steering member, wherein the first steering member has a first end and a second end; the first end is connected to the support, and the second end is pivotally connected to an end of the second steering member; another end of the second steering member is fixed to an end of the vertical rod which is exposed out of the axial tube; and a control structure including a pair of backrest canes, wherein each of the backrest canes is fixed to the first steering member with an end thereof, and another end of each of the backrest canes forms a handle.

2. The dual drive wheelchair of claim 1, wherein the support of the supporting structure comprises an extension tube and a connecting tube; and wherein the extension tube is connected to the front driving wheel set and an end of the connecting tube is fixed to the extension tube, and another end of the connecting tube is fixed to the axial tube; and the first turning structure further comprises a first shaft and a second shaft, wherein the first shaft passes through the connecting tube and the first end of the first steering member to connect the first steering member and the support; the second shaft passes through the second end of the first steering member and the second steering member.

3. The dual drive wheelchair of claim 2, wherein the first steering member comprises a sleeve, wherein the sleeve is provided between the first end and the connecting tube of the support, and wherein the first shaft passes through the sleeve and each of the backrest canes is fixed to the sleeve with the end.

4. The dual drive wheelchair of claim 2, wherein the extension tube of the support has a vertical section and a horizontal section; a top end of the vertical section is pivotally connected to the frame, and a bottom end of the vertical section is connected to the horizontal section, and wherein the pair of front wheels is provided in front of the horizontal section, and wherein the front driving wheel set further comprises a pair of pedals, wherein the pair of pedals drives the pair of front wheels to rotate.

5. The dual drive wheelchair of claim 4, wherein the front driving wheel set comprises a castor and a driving shaft set; the castor and the pair of pedals being provided in front of the horizontal section; the driving shaft set including a front driving shaft and a rear driving shaft, wherein the front driving shaft has two ends respectively connected to a crank, and each of the cranks is connected to a respective one of the pedals, and wherein the rear driving shaft has two ends respectively connected to one of the front wheels, and the rear driving shaft is drivable to rotate along with the front driving shaft.

6. The dual drive wheelchair of claim 5, wherein the support comprises a terminal tube connected to a front end of the horizontal section of the extension tube and the front driving wheel set comprises a cover tube and a fixing bolt, wherein the cover tube is connected to the terminal tube and has a first hole; the front driving shaft passes through the cover tube and has a second hole; and wherein the fixing bolt passes through the first hole and the second hole detachably.

7. The dual drive wheelchair of claim 6, wherein the front driving wheel set comprises a front gear, a rear gear, and a chain, wherein the cover tube is fixed to the center of the front gear, and the rear driving shaft is fixed to the center of the rear gear; and wherein the chain wraps around and meshes with the front gear and the rear gear.

8. The dual drive wheelchair of claim 6, further comprising a clasp ring which clasps the cover tube detachably, and wherein the clasp ring is fixed to an end of the fixing bolt.

9. The dual drive wheelchair of claim 5, wherein the support comprises a vertical tube; the front driving wheel set comprises an adapter tube, a fixing ring, and a spring, wherein the castor is provided to a bottom of the adapter tube, and the adapter tube is inserted into the vertical tube; the fixing ring is fixed in the vertical tube; and wherein the spring has two ends abutting against the fixing ring and the adapter tube respectively.

10. The dual drive wheelchair of claim 1, further comprising a second turning structure including two linkages intercrossed, wherein each of the two linkages has two ends to respectively connect to the support of the supporting structure and the vertical rod of the rear driving wheel set.

* * * * *